US005474608A

United States Patent [19]

Beisswanger

[11] Patent Number: 5,474,608

[45] Date of Patent: Dec. 12, 1995

[54] APPLICATOR FOR APPLICATION OF COATING COLOR ON A PAPER WEB

[75] Inventor: Rudolf Beisswanger, Steinheim, Germany

[73] Assignee: J. M. Voith GmbH, Heidenheim, Germany

[21] Appl. No.: 249,050

[22] Filed: May 25, 1994

Related U.S. Application Data

[63] Continuation of Ser. No. 18,099, Feb. 17, 1993, abandoned.

[30] Foreign Application Priority Data

Feb. 21, 1992 [DE] Germany ..... 42 05 314.5

[51] Int. Cl.[6] ..... B05C 1/08

[52] U.S. Cl. ..... 118/103; 118/119; 118/249

[58] Field of Search ..... 118/103, 118, 118/119, 123, 126, 249

[56] References Cited

U.S. PATENT DOCUMENTS 3,195,500 7/1965 Kuhnel ..... 118/126
4,310,573 1/1982 Damrau ..... 118/249
5,117,767 6/1992 Sommer ..... 118/249

FOREIGN PATENT DOCUMENTS 3605409 8/1987 Germany .
2178677 2/1987 United Kingdom ..... 118/249

*Primary Examiner*—Matthew O. Savage
*Attorney, Agent, or Firm*—Baker & Daniels

[57] ABSTRACT

An applicator for application of coating color on a paper web, including an applicator; a backing roll which wraps the paper web; an entrance gore formed between backing roll and applicator, and an outlet gore. A doctor follows the outlet gore for removing surplus coating color (doctor surplus) from the paper web. A deflector system is provided between the applicator and the doctor. The deflector system features a first guide surface for diverting a first coating color surplus from the outlet gore, as well as a second guide surface for the doctor surplus.

4 Claims, 3 Drawing Sheets

APPLICATOR FOR APPLICATION OF COATING COLOR ON A PAPER WEB

This is a continuation of U.S. application Ser. No. 08/018,099, filed Feb. 17, 1993 now abandoned.

BACKGROUND OF THE INVENTION

The invention concerns an applicator for application of coating color on a paper web, specifically a roll applicator.

Applicators of this general type are known from DE 36 05 409 A1. This device is intended to produce a uniform coating.

Problems occur with such applicators especially in the wedge-shaped entrance zone between the applicator roll and backing roll, particularly at high speeds, but also in the exit zone, before the paper web provided with coating color reaches the doctor blade. The doctor blade must fulfill decisive functions here. It is to contribute to producing a continuous and relatively thick layer which is completely smooth and free of doctor blade striae. Various types of doctor blade are conceivable, for instance with a stiff blade, with a bent blade which in its end area tangentially makes intimate contact with the coated paper web, and roll doctors. The equipment expense for such doctor systems is quite considerable. Nonetheless, the doctor devices known so far have not met demands in terms of coating quality.

The problem underlying the invention is to so design an applicator for application of coating color on a web that the coating quality will be further improved, particularly with regard to the smoothness of the coat, continuity of the coating surface and with regard to the sensitive dosing of the coating weight, all at a reasonable cost.

SUMMARY OF THE INVENTION

This problem is solved by the features of the present invention. An applicator for application of coating color on a paper web, specifically a roll applicator, is provided. The applicator includes an applicator device, such as an applicator roll or application nozzle. A backing roll is provided, around which wraps the paper web. An entrance gore is formed between backing roll and applicator device, as well as an exit gore. Following the exit gore, a doctor is provided for doctoring surplus coating color (doctor surplus) off the paper web. A deflector system is provided between the applicator and the doctor, which deflector system features a first guide surface for diverting a first coating color surplus out of the exit gore, and a second guide surface for the doctor surplus.

Accordingly, a deflector is provided between the actual application zone and the doctor. The deflector comprises a first guide surface for diversion of a first coating color surplus from the exit gore, and a second guide surface for the doctor surplus. The two guide surfaces converge in a terminal edge where the two streams of surplus meet.

The inventive features provide a better control of the difficult area of the exit gore. Thus, a predoctoring is taking place, which eventually results in a better coating quality of the coating color surface, particularly a greater smoothness.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
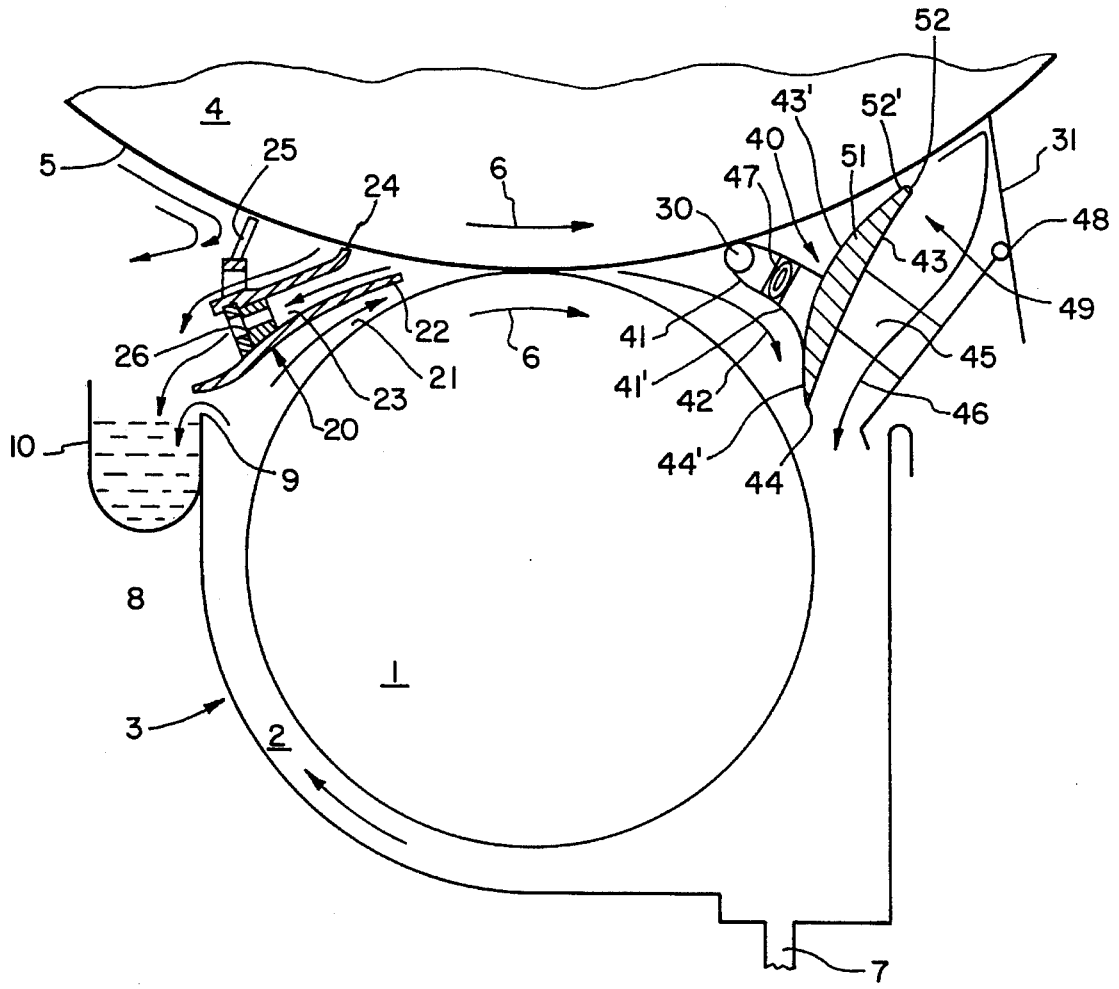
FIG. 1 shows a roll applicator according to the invention in side elevation.

The roll applicator illustrated in FIG. 1 comprises an applicator roll 1 which rotates in a coating color sump 2. The coating color 2 is contained in a trough 3. Coordinated with the applicator roll 1 is a backing roll 4 around which wraps a paper web 5. Both rolls rotate in opposite directions in the sense of arrows 6, but not at the same peripheral speed (ratio $v_{\text{backing roll}}$: $v_{\text{applicator roll}}$ =10). They form together a wedge-shaped entrance gore, at the left in the illustration, as well as a wedge-shaped exit gore at the right in the illustration.

The trough 3 features a coating color inlet 7. In the rising region of the applicator roll 1, the trough wall is fashioned as a guide wall 8. It ends in an overflow edge 9 ("first overflow edge"). Connected to this point is an overflow chute 10 for a first overflow stream.

Bordering on the guide wall 8—after the overflow edge 9—is a guide element 20. It extends toward the entrance gore and forms together with the shell surface of the applicator roll 1 a flow channel 21. On its downstream end it forms a second overflow edge 22 for a second overflow stream.

The guide element 20 features a drain channel 23 serving to drain a second overflow stream. This stream is created in that surplus coating color crosses the overflow edge 22 and flows—through the drain channel 23—opposite to the flow direction in the flow channel 21.

In addition, the guide element 20 features a constriction 24 which may serve as an overflow edge and forms then the third overflow edge. Moreover, the guide element supports an air scraper 25. The flow (drain) channel 23 is provided with a valve 26 on its downstream end.

The three overflow streams crossing the overflow edges 9, 22, and 24 all empty in a single collection chute, namely the overflow chute 10.

Following its passage of the application zone, the coated paper web 5 proceeds into the exit gore. It passes there an equalizer rod 30, and eventually a doctor 31. This region is of prime significance for the present invention.

The equalizer rod 30 is an integral part of a deflector 40. This deflector features a first guide surface 41' for diversion of a first coating color surplus 42 from the exit gore, and a second guide surface 43 for the doctor surplus 46 accruing at the doctor 31.

The two guide surfaces 41', 43 converge in a terminal edge 44, which presently extends acutely, and where the two overflow streams 42, 46 meet.

The first guide surface 41' is rigid with a concave curvature, the second guide surface 43 is somewhat less strong. The deflector 40 is attached to the fixed surrounding by means of consoles 45. These consist of relatively thin plates which—distributed across the width of the machine—are arranged side-by-side with spaces in between.

The equalizer rod 30 can be forced more or less heavily on the coated paper web 5 by means of an inflatable rubber hose (bellows) 47.

The deflector 40 is hinged to a knuckle 48 allowing it to pivot in the direction of arrow 49. It can be locked in various angular positions.

Figure 2:
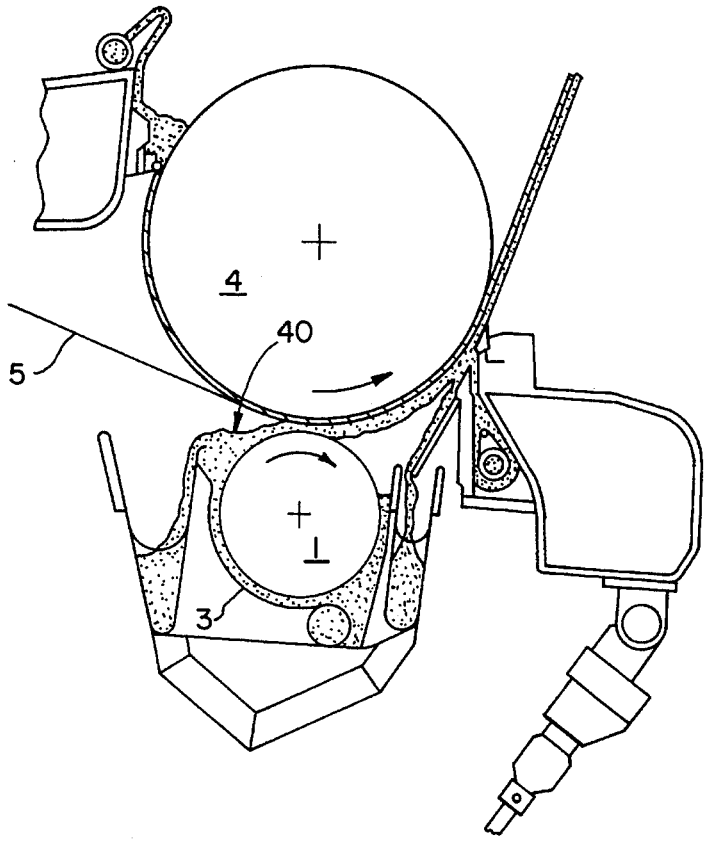
PRIOR ART FIG. 2
FIG. 2 shows a roll applicator according to the prior art.

As opposed thereto, FIG. 2 shows a roll applicator according to the prior art. The basic elements are also present, namely the applicator roll 1, backing roll 4, trough 3 etc. Absent, however, is the deflector designed according to the invention.

The two doctors, i.e., the predoctor 30 and also the last doctor 31, may be designed differently. They may be fashioned, e.g., as a blade, as a roll doctor or as a smooth rod.

As is evident from FIG. 1, the deflector 40 may in the inventional design feature an element 51 which in cross section has the shape of an airfoil. In its end area 52' it extends essentially tangentially to the paper web 5. With its end area it is able to make intimate contact with the paper web 5 in order to achieve a further smoothing of the coating color application. In summary, the embodiment of FIG.4 includes a deflector 40 positioned between applicator roll 1 and doctor element 31 along the direction of travel of the web 5. The deflector includes a deflector portion 51 shaped like an airfoil having a convex surface 43' facing the exit gore and a first concave guiding surface 43 facing in a direction away from the exit gore. The convex surface 43' and first concave guiding surface 43 converge in a first end 52 proximate the direction of travel of the paper web and a terminal edge 44 positioned adjacent collection trough 3 and applicator roll 1. The convex surface includes end area 52' adjacent first end 52 that extends tangentially of the direction of web travel for intimately contacting the web. The convex surface includes a terminal guide surface 44' adjacent terminal edge 44. The first stream 46 of color coating doctored by doctor element 31 is guided by the first concave guiding surface to terminal edge 44 into collection trough 3. The deflector further includes a second deflector portion 41 attached to convex surface 43' of first deflector portion 51. The second portion includes an equalizer rod 30 for doctoring a second stream of surplus color 42 coating from the paper web. The second deflector portion including a means 47 for forcing equalizer rod 30 against the web. The second deflector portion defines a second concave guide surface 41' facing applicator roll 1 and extending continuously from equalizer rod 30 to terminal guide surface 44' for guiding the second stream 42 from the equalizer rod to terminal edge 44 to meet with first stream 46.

Figure 3:
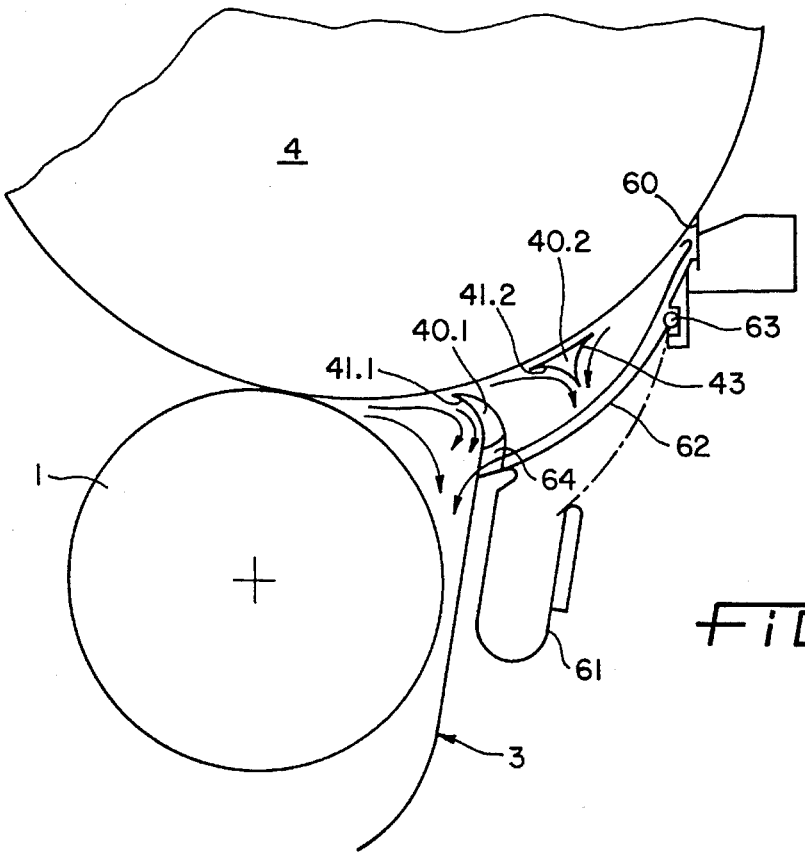
FIG. 3 shows another embodiment of the applicator of the present invention which includes additional deflectors.

The roll applicator illustrated in FIG. 3 comprises again the classic elements, namely an applicator roll 1 and a backing roll 4. The entrance area with the entrance guide element is not illustrated here. But these or similar elements, of course, are present in practice. Important for the invention, again, is here the design of the deflector device. It comprises two individual deflectors 40.1 and 40.2. These two deflectors each have a guide surface 41.1 and 41.2, respectively. The second deflector 40.2 possesses a second guide surface 43, which serves to divert the doctor surplus accruing on the doctor 60. Also, there is a collection chute 61. A pivotable guide plate 62 is hinged to a knuckle 63. In the illustrated position it passes the doctor surplus back again to the trough 3. In the position indicated by dash-dot line, contrarily, it would pass the doctor surplus to the collection chute 61. As can be seen, the first deflector 40.1 features cutouts 64 through which the doctor surplus in the first case can proceed into the trough.

Figure 4:
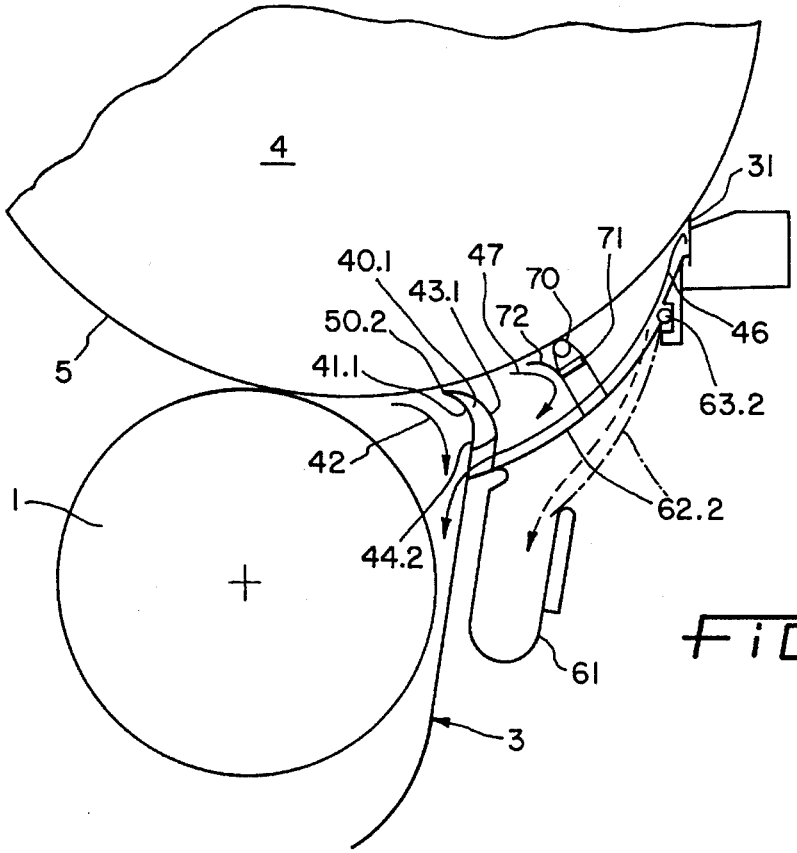
FIG. 4 shows another embodiment of the applicator of the present invention wherein a predosing doctor has been substituted for one of the deflectors shown in FIG. 3.

In the embodiment according to FIG. 4, a predosing doctor 70 is provided instead of the second deflector 40.2. This doctor is provided with a contact air hose 71, and a return plate 72 having a curvature similar to that of the first deflector 40.1. In summary, the embodiment of FIG.4 includes a deflector 40.1 positioned between applicator roll 1 and doctor element 31 along the direction of travel of the web 5. The deflector includes a concave guide surface 41.1 facing the exit gore and a convex surface 43.1 facing in a direction away from the exit gore. Concave guide surface 41.1 and convex surface 43.1 converge in a first end 50.2 proximate the direction of web travel and a terminal edge 44.2 adjacent applicator roll 1 and collection trough 3. The concave guide surface 41.1 guides a second stream 42 of surplus color coating material from first end 50.2 to terminal edge 44.2 into collection trough 3. An equalizer rod 70 doctors a third stream 47 of surplus color coating from the paper web. Means 71 is provided for forcing equalizer rod 70 against the web. The equalizer rod is positioned along the direction of web travel at a point between deflector 40.1 and doctor element 31. A guide plate 62.2 is provided for guiding the first and third streams 46,47 such that the first and third streams meet with the second stream for collection in collection trough 3. A collection chute 61 is provided for collecting the first stream doctored by doctor element 31. The guide plate 62.2 is pivotable into respective first and second positions about an axle or knuckle 63.2 that is parallel to backing roll 4 and applicator roll 1 such that when the guide plate is in the first position the first stream is diverted into collection trough 3, and when the guide plate is in said second position the first stream is diverted into collection chute 61.

Figure 5:
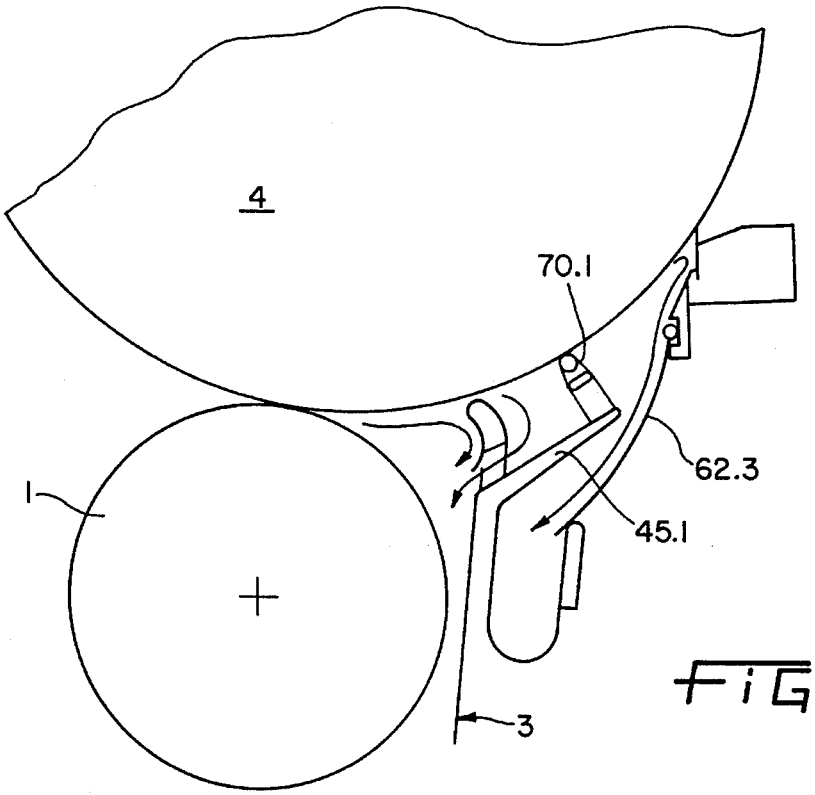
FIG. 5 shows a further embodiment of the invention.

The roll applicator according to FIG. 5 shows a variant of the deflector system shown in FIG. 4 in which the pre-dosing doctor 70.1 is fixedly mounted separately form the pivotable guide plate 62.3 via a support means 45.1.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An applicator for applying a color coating on a traveling paper web including a backing roll, said travelling paper web being wrapped around said backing roll and having a direction of travel, an applicator roll, said applicator roll being situated with respect to said backing roll so that an entrance gore for the traveling paper web and an exit gore are defined therebetween, and a doctor element for doctoring a first stream of surplus color coating from the paper web, the doctor element being positioned after the exit gore along the direction of travel of the web, and a collection trough adjacent said exit gore and said applicator roll, wherein the improvement comprises:

a deflector positioned between said applicator roll and said doctor element along the direction of travel of the web;

wherein said deflector includes a first deflector portion shaped like an airfoil, said first deflector portion having a convex surface facing said exit gore and a first concave guiding surface facing in a direction away from said exit gore, said convex surface and said first concave guiding surface converging in a first end proximate said direction of travel of the paper web and a terminal edge positioned adjacent said collection trough and said applicator roll, said convex surface including end area adjacent said first end that extends tangentially of said direction of travel for intimately contacting said web, said convex surface including a terminal guide surface adjacent said terminal edge, whereby said first stream is guided by the first concave guiding surface to said terminal edge into said collection trough;

wherein said deflector includes a second deflector portion attached to said convex surface of said first deflector portion, said second portion including an equalizer rod for doctoring a second stream of surplus color coating from the paper web, said second deflector portion including means for forcing said equalizer rod against said web, said second deflector portion defining a second concave guide surface facing said applicator roll and extending continuously from said equalizer rod to said terminal guide surface for guiding said second stream from said equalizer rod to said terminal edge to meet with said first stream.

2. The applicator of claim 1, wherein said means for forcing comprises an inflatable bellows.

3. An applicator for applying a color coating on a traveling paper web including a backing roll, said travelling paper web being wrapped around said backing roll and having a direction of travel, an applicator roll, said applicator roll being situated with respect to said backing roll so that an entrance gore for the traveling paper web and an exit gore are defined therebetween, and a doctor element for doctoring a first stream of surplus color coating from the paper web, the doctor element being positioned after the exit gore along the direction of travel of the web, and a collection trough adjacent said exit gore and said applicator roll, wherein the improvement comprises:

a deflector positioned between said applicator roll and said doctor element along the direction of travel of the web, said deflector including a concave guide surface facing said exit gore and a convex surface facing in a direction away from said exit gore, said concave guide surface and said convex surface converging in a first end proximate said direction of travel and a terminal edge adjacent said applicator roll and said collection trough, whereby said concave guide surface guides a second stream of surplus color coating material from said first end to said terminal edge into said collection trough;

an equalizer rod for doctoring a third stream of surplus color coating from the paper web, and means for forcing said equalizer rod against said web, wherein said equalizer rod is positioned along said direction of travel at a point between said deflector and said doctor element;

and means for guiding said first and third streams such that said first and third streams meet with said second stream for collection in said collection trough.

4. The applicator of claim 3, further comprising a collection chute for said first stream doctored by said doctor element, wherein said means for guiding includes a guide plate for diverting said first stream doctored by said doctor element, said guide plate being pivotable into respective first and second positions about an axle that is parallel to said backing roll and applicator roll such that when said guide plate is in said first position the first stream is diverted into said collection trough, and when said guide plate is in said second position said first stream is diverted into said collection chute.

* * * * *